United States Patent [19]

Wagenknecht

[11] 4,087,336

[45] May 2, 1978

[54] ELECTROLYTIC REDUCTIVE COUPLING OF HYDROXYBENZALDEHYDES

[75] Inventor: John H. Wagenknecht, Kirkwood, Mo.

[73] Assignee: Monsanto Company, St. Louis, Mo.

[21] Appl. No.: 754,649

[22] Filed: Dec. 27, 1976

[51] Int. Cl.[2] ..... C25B 3/04; C25B 3/10; C07C 31/20; C07C 39/00

[52] U.S. Cl. ..... 204/75; 204/72; 204/77

[58] Field of Search ..... 204/73 R, 75, 77, 59 R, 204/72

[56] References Cited

U.S. PATENT DOCUMENTS 3,200,053 8/1965 Yost ..... 204/75

3,616,320 10/1971 Beck et al. ..... 204/73 A 3,899,401 8/1975 Nohe et al. ..... 204/59 R

OTHER PUBLICATIONS

Organic Electrode Processes by Allen, pp. 62–64, 82, published by Chapman & Hall, Ltd., London 1958.

Allen, J. Amer. Chem. Soc. 72, 3797, 8 8/50.

Powers et al., J. Amer. Chem. Soc., 80, 808–811, 2/58.

*Primary Examiner*—F.C. Edmundson

*Attorney, Agent, or Firm*—Wendell W. Brooks; Joseph D. Kennedy; James W. Williams

[57] ABSTRACT

Electrolytic reductive coupling of hydroxybenzaldehydes in an aqueous alkaline electrolysis medium in an undivided electrolytic cell yields 1,2-bis(hydroxyphenyl)ethane-1,2-diols.

13 Claims, No Drawings

ELECTROLYTIC REDUCTIVE COUPLING OF HYDROXYBENZALDEHYDES

BACKGROUND OF THE INVENTION

This invention relates to the electrolytic reduction of hydroxybenzaldehydes to produce the corresponding 1,2-bis(hydroxyphenyl)ethane-1,2-diol (dihydroxybenzoin). More particularly, this invention relates to the electrolytic reductive coupling of hydroxybenzaldehydes by electrolysis in an aqueous alkaline electrolysis medium in an undivided electrolytic cell to produce 1,2-bis(hydroxyphenyl)ethane-1,2-diols.

Electrolytic reductive coupling of hydroxybenzaldehydes to prepare the corresponding 1,2-bis(hydroxyphenyl)ethane-1,2-diols has previously been accomplished in good yields. See, for example, Grimshaw et al, *Journal of the Chemical Society* (C), 653 (1966). However, each of the methods described in the prior art employed a divided cell. Such cells, of course, suffer from numerous inherent difficulties. For example, a divided cell is inherently more complex than an undivided cell, thereby incurring higher costs in cell construction. In addition, a divided cell exhibits a higher internal resistance than an undivided cell. As a result, efforts to adapt such divided-cell electrolytic methods of preparing 1,2-bis(hydroxyphenyl)ethane-1,2-diols to commercial production on a large technical scale have been severely limited.

While undivided cells do not suffer from the difficulties associated with divided cells, such cells have not been employed for the electrolytic reductive coupling of hydroxybenzaldehydes, apparently because of the general expectation that the well-known anodic oxidative coupling reactions which phenols are prone to undergo would occur to give unwanted by-products, particularly in an alkaline medium.

The difficulties and disadvantages encountered in the prior art processes of electrolytic reductive coupling of hydroxybenzaldehydes are overcome by the discovery that the electrolytic reductive coupling of hydroxybenzaldehydes to yield 1,2-bis(hydroxyphenyl)ethane-1,2-diols is conveniently accomplished in an undivided cell, a decided advance in the state of the art.

SUMMARY OF THE INVENTION

According to the present invention, it has been discovered that hydroxybenzaldehydes can undergo electrolytic reductive coupling at the aldehyde functionality in an undivided cell to yield 1,2-bis(hydroxyphenyl)ethane-1,2-diols.

The 1,2-bis(hydroxyphenyl)ethane-1,2-diol products obtained in the present process can readily be recovered by known procedures, as described in the prior art.

DETAILED DESCRIPTION OF THE INVENTION

Electrolytic reductive coupling of hydroxybenzaldehydes in an undivided cell leads to 1,2-bis(hydroxyphenyl)-ethane-1,2-diols.

In accordance with the present process, an electric current is passed through an aqueous alkaline electrolysis medium comprising the hydroxybenzaldehyde and aqueous solvent in an undivided cell.

The hydroxybenzaldehydes suitable for use in the present process are represented by the formula:

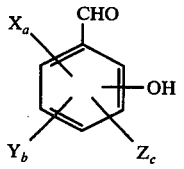

wherein X represents alkyl of 1 to 6 carbon atoms; Y represents alkoxy containing an alkyl of 1 to 6 carbon atoms; Z represents any non-interfering substituent, excluding alkyl and alkoxy; and *a, b,* and *c* each independently represent an interger from 0 (zero) to 4, inclusive, with the proviso that the sum of *a, b,* and *c* does not exceed 4.

The term "non-interfering substituent" is employed herein to mean a substituent which can be present in the hydroxybenzaldehyde without causing substantial adverse alteration of either the course of the desired reductive coupling of such hydroxybenzaldehydes nor the yield of the desired product under process conditions.

Representative of hydroxybenzaldehydes suitable for use in the present process are 2-hydroxybenzaldehyde (o-hydroxybenzaldehyde, 3-hydroxybenzaldehyde (m-hydroxybenzaldehyde), 4-hydroxybenzaldehyde (p-hydroxybenzaldehyde), 2-hydroxy-3-methylbenzaldehyde, 3-hydroxy-5-methylbenzaldehyde, 4-hydroxy-3-methylbenzaldehyde, 2-hydroxy-3-ethylbenzaldehyde, 3-hydroxy-5-ethylbenzaldehyde, 4-hydroxy-3-ethylbenzaldehyde, 2-hydroxy-3-n-butylbenzaldehyde, 3-hydroxy-5-n-butylbenzaldehyde, 4-hydroxy-3-n-butylbenzaldehyde, 2-hydroxy-3-i-butylbenzaldehyde, 3-hydroxy-5-i-butylbenzaldehyde, 4-hydroxy-3-i-butylbenzaldehyde, 2-hydroxy-3-n-hexylbenzaldehyde, 3-hydroxy-5-n-hexylbenzaldehyde, 4-hydroxy-3-n-hexylbenzaldehyde, 2-hydroxy-3-methoxybenzaldehyde, 3-hydroxy-5-methoxybenzaldehyde, 4-hydroxy-3-methoxybenzaldehyde (vanillin), 2-hydroxy-3-ethoxybenzaldehyde, 3-hydroxy-5-ethoxybenzaldehyde, 4-hydroxy-3-ethoxybenzaldehyde, 2-hydroxy-3-n-butoxybenzaldehyde, 3-hydroxy-5-n-butoxybenzaldehyde, 4-hydroxy-3-n-butoxybenzaldehyde, 2-hydroxy-3-n-hexoxybenzaldehyde, 3-hydroxy-5-n-hexoxybenzoldehyde, 4-hydroxy-3-n-hexoxybenzaldehyde, 2-hydroxy-3-methoxy-5-methylbenzaldehyde, 4-hydroxy-3-methoxy-5-methylbenzaldehyde, and the like. Of these, 4-hydroxybenzaldehyde is particularly important in that the coupled product therefrom, 1,2-bis-(4-hydroxyphenyl)ethane-1,2-diol (4,4'-dihydroxyhydrobenzoin), can readily be converted to 1,2-bis-(4-hydroxyphenyl)ethane which is very useful as an antioxidant and as a symmetrical bifunctional intermediate in the preparation of epoxy resins, polycarbonates, polyesters, and the like. It is, of course, apparent that the corresponding products from other suitable hydroxybenzaldehydes may be similarly employed even though they may not be symmetrical.

In carrying out the present process, a hydroxybenzaldehyde is charged to an undivided electrolytic cell fitted with a cathode and an anode, and an electromotive force is impressed upon the cell whereby the hydroxybenzaldehyde undergoes electrolytic reductive coupling to yield a 1,2-bis(hydroxyphenyl)ethane-1,2-diol in which the coupling occurs at the aldehyde functionality. The reaction involved can be illustrated as follows:

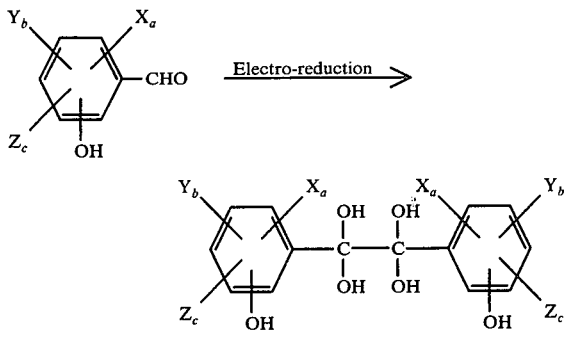

wherein X, Y, and Z, and *a, b,* and *c* are as defined hereinabove.

The electrolysis is carried out in an aqueous alkaline electrolysis medium which permits the reduction to occur at the cathode without simultaneously effecting an undesired oxidative coupling at the anode, even though the medium obviously is in contact with both the cathode and anode. Alcohols such as methanol and ethanol can also be added to the electrolysis medium up to about 50 percent by weight, if desired; however, ordinarily the addition of such additional solvents is unnecessary and offers no particular advantage.

In an exemplary method of conducting the present process, a solution of the hydroxybenzaldehyde (about 2.0 percent to about 30 percent by weight, or on a molar basis, about 0.1 molar to about 2.5 molar) dissolved in aqueous sodium hydroxide (about 2.0 percent to about 30 percent, or on a molar basis, about 0.5 molar to about 7.5 molar, and usually about 5 percent to about 20 percent, or on a molar basis about 1.0 molar to about 5.0 molar) is charged to an undivided electrolytic cell maintained at a temperature between about 20° C and about 60° C and having a steel, lead(IV) oxide, carbon, or graphite anode and a lead, cadmium, or mercury cathode. Other suitable bases can be employed in the same or similar concentration ranges so long as the base to hydroxybenzaldehyde molar ratio is at least 1:1. An electric current is then impressed on the cell by connecting the anode and cathode to a proper source of direct current with controls to maintain the current density at between about 0.01 and 200 or more milliamperes per square centimeter for a time sufficient to cause reductive coupling of the hydroxybenzaldehyde to the corresponding 1,2-bis(hydroxyphenyl)ethane-1,2-diol, which then is isolated as described hereinbelow.

The concentration of the hydroxybenzaldehyde compound employed in the process of the present invention is not critical and limited only by the solubility of the starting material in the aqueous alkaline medium. Thus, for example, although concentrations as low as 0.01 percent by weight in the medium can be employed, for reasons of efficiency and economy, it is preferred to employ concentrations of from about 5.0 percent to about 30.0 percent by weight, or even higher, of the hydroxybenzaldehyde in the aqueous alkaline electrolysis medium.

The temperature at which the process of the instant invention is conducted is not narrowly critical and can range from as low as 0° C to as high as 80° C. As is apparent to those skilled in the art, at lower temperatures a very dilute solution must be employed since the solubility of the hydroxybenzaldehyde starting material is lower at lower temperatures. For this reason, it is generally preferred to employ temperatures between about 20° C and about 60° C, and usually between about 25° C and about 50° C.

The process of the present invention can be conducted at atmospheric pressure, super atmospheric pressures, and subatmospheric pressures. For reasons of economy and ease of construction of the equipment employed in the present process, it is preferred to conduct this process at atmospheric pressure.

The current densities employed in the process of the present invention can range from as low as 0.001 ampere (1.0 milliampere) per square centimeter to 0.5 amperes (500 milliamperes) per square centimeter of cathode surface area.

The type of electrolytic cell employed in the process of the instant invention is not critical. The cell can consist of a glass container having one or more anodes and cathodes connected to a source of direct electric current such as a battery and the like. The cell can also consist of the two electrodes separated by an insulator such as a rubber or other non-conducting gasket or spacer. In such a cell, which is conveniently described as a "sandwich-type" electrolytic cell, the electrolysis medium is preferably flowed past the (two) parallel electrodes (cathode and anode) in a recirculating system. Such an arrangement allows large volumes of the electrolysis medium to be effectively subjected to electrolysis in a relatively small cell having a preferred closely-spaced electrode surfaces.

It is apparent, of course, that in the undivided electrolytic cells suitable for use in the present process, the electrolysis medium containing the hydroxybenzaldehyde reactant is in contact with both the cathode and anode during the reaction process with little, if any, adverse effect being experienced. Indeed such a phenomenon is quite surprising and unexpected in view of the well-known anodic oxidative coupling reactions which phenols are prone to undergo to give unwanted by-products, particularly in an alkaline medium such as herein employed.

The electrodes, that is, the anode and cathode, employed in the process of the present invention can be constructed of a wide variety of conductive materials. Thus, anode materials suitable for use in the present process include, for example, steel, lead(IV) oxide, carbon, graphite, and the like, with steel generally being preferred because of its greater stability against corrosion.

The cathodes can also be of any conductive substances so long as such substances do not cause, to any significant extent, undesired side reactions, such as reduction of the aldehyde functionality to the corresponding alcohol functionality. For example, lead, cadmium, and mercury cathodes are suitable.

The bases which can be employed to render the aqueous electrolysis medium alkaline or basic include the alkali metal oxides and hydroxides such as, for example, sodium, potassium, rubidium, and cesium, oxides and hydroxides, and quaternary ammonium hydroxides such as tetraalkylammonium hydroxides, for example, tetramethylammonium hydroxide, tetraethylammonium hydroxide, tetra-n-butylammonium hydroxide, and the like.

The term "quaternary ammonium" as employed herein has its usual recognized meaning of a cation having four organic groups substituted on the nitrogen.

In general, the alkali metal hydroxides, for example, sodium hydroxide, are preferred for use as the base in the present process for economic reasons. However, it will be recognized that in certain instances the quaternary ammonium hydroxides might be preferred due to the greater solubility of the hydroxybenzaldehydes in such solutions.

It is, of course, apparent to those skilled in the art that the time of reaction is variable and is determined by variables such as current density, electrode surface area, concentration, and volume of the reaction solution.

The present process is suited to either batch or continuous operations. Continuous operations can involve recirculation of a flowing electrolyte stream, or streams between the electrodes, with continuous or intermittent sampling of the stream for product removal. Additional reactants can also be added continuously or intermittently, and other electrolyte components can be augmented, replenished, or removed as appropriate.

It is, of course, apparent to those skilled in the art that the aqueous alkaline electrolysis medium must have sufficient conductivity to conduct the electrolysis current. While media of less than ideal conductivity can be employed, it is preferred from an economic viewpoint not to have too high a resistance. The conductivity can, if desired, be enhanced by the addition of common supporting electrolytes such as electrolyte salts having sufficiently high discharge potentials to the aqueous alkaline electrolysis medium. In general, however, with the combination of hydroxybenzaldehyde, base, and aqueous solvent employed in the present process, the addition of a supporting electrolyte to the electrolysis medium is not actually necessary, or even desirable.

The term "supporting electrolyte" as employed herein is an electrolyte capable of carrying electric current but not discharging under electrolysis conditions. It will be recognized, of course, that discharge potentials will vary with electrode materials and their surface conditions and various materials in the electrolysis medium.

The term "salt" is employed in its generally recognized sense to indicate a compound composed of a cation and an anion, such as produced by the reaction of an acid with a base.

The supporting electrolytes which can be employed to enhance the conductivity of the aqueous alkaline electrolysis medium include alkali metal and quaternary ammonium phosphates, perchlorates, carbonates, tetrafluoroborates, hexafluorophosphates, and the like. Specific examples of such supporting electrolytes are salts such as sodium, potassium, rubidium, and cesium phosphates, sodium, potassium, rubidium, and cesium perchlorates, sodium, potassium, rubidium, and cesium carbonates, sodium, potassium, rubidium, and cesium tetrafluoroborates, sodium, potassium, rubidium, and cesium hexafluorophosphates, and tetraethylammonium, tetra-n-propylammonium, and tetra-n-butylammonium phosphates, tetraethylammonium, tetra-n-propylammonium, and tetra-n-butylammonium perchlorates, tetraethylammonium, tetra-n-propylammonium, and tetra-n-butylammonium carbonates, tetraethylammonium, tetra-n-propylammonium, and tetra-n-butylammonium tetrafluoroborates, tetraethylammonium, tetra-n-propylammonium, and tetra-n-butylammonium hexafluorophosphates, and the like.

The concentration of electrolyte salts, when used, can vary widely, for example, from about 0.5 percent to about 30 percent or more by weight of the electrolysis medium, but suitable concentrations will often be in the range of about 1.0 percent to about 15 percent by weight or, on a molar basis, often in the range of about 0.1 molar to about 1.0 molar. If, however, it is desired to have all the components in solution, which state is preferred, the amount of electrolyte salt utilized will be no greater than will dissolve in the electrolysis medium.

The 1,2-bis(hydroxyphenyl)ethane-1,2-diol products obtained in the present process can be readily recovered by known procedures. It will be understood, however, that the isolation procedures employed in the procedural Examples and discussed hereinbelow are primarily for illustration purposes. Other procedures can be employed, and may be preferred, for commercial use.

Upon completion of the electrolysis, the resultant reaction solution is acidified to about pH 6 by the addition of an appropriate acid such as acetic or dilute hydrochloric acid, or other suitable mineral acid, and cooled. The precipitate is collected by suction filtration, washed, and dried to yield the 1,2-bis(hydroxyphenyl)ethane-1,2-diol. Recrystallization, if desired, can be effected from a suitable solvent, for example, methanol, ethanol, and the like to yield the pure product.

If the volume of the reaction solution is excessively large, it can be reduced to a conveniently manageable volume by partial evaporation in vacuo. The resultant reduced-volume solution can then be treated as described hereinabove to yield the 1,2-bis(hydroxyphenyl)ethane-1,2-diol product.

If the product is a liquid or an oil, it can be isolated by extraction of the acidified reaction solution with an appropriate solvent, for example, ethyl acetate, methylene chloride, chloroform, ether, benzene, and the like, dried, and evaporated in vacuo to yield the product. Purification may be effected by the usual means, for example, distillation at an appropriate temperature and pressure.

Thus the present invention provides a significant advance in the state of the art by effecting reductive coupling of hydroxybenzaldehydes to 1,2-bis(hydroxyphenyl)ethane-1,2-diols in an undivided electrolytic cell.

The following examples illustrate the present invention and the manner by which it can be practiced.

EXAMPLE 1

A 600-milliliter beaker fitted with a mercury pool cathode (50 square centimeters surface area), a water-cooled tubular stainless steel anode [0.25 inch (0.64 centimeter) diameter], and an overhead mechanical stirrer was used as an electrolytic cell. A saturated calomel electrode was placed just next to the cathode surface to serve as a reference electrode and a thermometer was suspended in the beaker to measure the temperature of the solution being subjected to electrolysis.

The electrolytic cell was charged with 100 milliliters of 1.5 molar aqueous sodium hydroxide and 10.0 grams (0.082 mole) of 2-hydroxybenzaldehyde (salicylaldehyde). The electrolysis was conducted at a constant current of 3.0 amperes and a temperature of 28° C to 32° C over a 1-hour period. The cathode potential was −1.67 volts versus the saturated calomel electrode. Upon completion of the electrolysis, the solution was acidified to about 6.3 by the addition of glacial acetic acid and extracted with three 100-milliliter portions of ethyl acetate. The ethyl acetate extracts were combined, washed with three 100-milliliter portions of water, and dried over anhydrous magnesium sulfate. Evaporation of the solvent in vacuo and drying of the resulting oil material in a vacuum dessicator yielded 9.3 grams (46.0 percent) of 1,2-bis(2-hydroxyphenyl)-ethane-1,2-diol (2,2'-dihydroxyhydrobenzoin) as a mixture of oil and crystals. The identity of the material was confirmed by nuclear magnetic resonance spectroscopy in pyridine-$d_5$.

EXAMPLE 2

The electrolytic apparatus described in EXAMPLE 1 above was employed. It was charged with 200 milliliters of 1.5 molar aqueous sodium hydroxide and 20.0 grams (0.16 mole) of 3-hydroxybenzaldehyde. The electrolysis was conducted at a constant current of 3.0 amperes and a temperature of 30° C over an 1.3-hour period. The cathode potential was −1.4 to −2.2 volts versus the saturated calomel electrode. Upon completion of the electrolysis, the solution was acidified to about pH 6.3 and seeded with authentic crystals of 1,2-bis(3-hydroxyphenyl)ethane-1,2-diol (3,3'-dihydroxyhydrobenzoin) to induce crystallization of the product. The tan-colored precipitate was collected by suction filtration, washed with water, and dried to yield 9.2 grams (23.4 percent) of 1,2-bis(3-hydroxyphenyl)ethane-1,2-diol, melting point, 222°–225° C. Nuclear magnetic resonance spectroscopic analysis in pyridine-$d_5$ confirmed the structure of the product as 1,2-bis(3-hydroxyphenyl)ethane-1,2-diol.

The small yield (23.4 percent) was apparently due to the fact that a portion of the product was lost due to the extreme solubility of one of the stereoisomers in water.

EXAMPLE 3

A 4-liter beaker lined with a lead foil cathode (150 square centimeters surface area) and with a water-cooled (as needed) tubular stainless steel anode [0.25 inch (0.64 centimeter) diameter] placed in the center was used as an electrolytic cell. A saturated calomel electrode was placed just next to the cathode surface to serve as a reference electrode and a thermometer was suspended in the beaker to measure the temperature of the solution being electrolyzed. Vigorous agitation of the product solution was accomplished by a magnetic stirrer.

The electrolysis cell was charged with 400 grams (3.28 moles) of 4-hydroxybenzaldehyde and 3500 milliliters 2.0 molar aqueous sodium hydroxide. The mixture was warmed on a stirrer-hotplate to about 45° C to effect complete dissolution. Then a small amount of Union Carbide SAG 470 silicone antifoam agent was added. The electrolysis was conducted at a constant current of 25 amperes and a temperature range between about 44° C and about 49° C over an 8-hour period. The cathode potential was −2.0 to about −2.1 volts versus the saturated calomel electrode. Upon completion of the electrolysis, the product solution was allowed to cool to ambient temperatures and removed from the cell. The cell was washed with water and the washings added to the product solution. The volume of the combined product solution and washings was reduced to approximately 1,500 milliliters by evaporation in vacuo. The remaining solution was acidified to about pH 6.3 by the dropwise addition of acetic acid at the rate of 20 milliliters per minute. A total of 450 milliliters of acetic acid was added. The solution was cooled in an ice-water bath to induce crystallization. The precipitate was collected by suction filtration, washed with cold water, and dried to yield 299.0 grams (74.1 percent) of 1,2-bis(4-hydroxyphenyl)-ethane-1,2-diol.

EXAMPLE 4

The reaction was carried out in an undivided sandwichtype electrolytic cell (Southwestern Analytical Chem., Inc.) comprising a polished cadmium cathode and a mild steel anode spaced 0.2 centimeter apart by a neoprene rubber insulator so as to form a cavity between the two electrodes. The entire assembly was held together by back plates with bolts through them to make a tight seal, and arranged in such a manner that the height was 10 centimeters and the width was 5 centimeters, giving an apparent surface area of 50 square centimeters. The mild steel anode had in one side an inlet and in the opposite side an outlet. The outlet was connected to a 500-milliliter reservoir which was connected to a Vanton flexiliner pump which, in turn, was connected to the inlet. The electrical leads were connected to the electrodes at the inlet side of the assembly.

A solution containing 20.0 grams (0.16 mole) of 4-hydroxybenzaldehyde and 200 milliliters of 1.0 molar aqueous sodium hydroxide was charged to the reservoir. Also charged to the reservoir was a small amount of Union Carbide SAG 470 silicone antifoam agent. The solution was circulated through the cell at a flow rate of about 1500 milliliters per minute. The electrolysis was conducted at a constant current of 5.0 amperes and a temperature of 30° C over a 1.36-hour (4900-second) period. After the electrolysis had been completed, the solution was removed from the apparatus, which was then washed with water. The combined solution and washings were reduced in volume to 100 milliliters by evaporation in vacuo. The remaining solution was acidified to about pH 6.3 by the dropwise addition of dilute (approximately 6 molar) hydrochloric acid and cooled to 15° C in an ice-water bath. The precipitate was collected by suction filtration, washed with cold water, and dried to yield 15.2 grams of 1,2-bis(4-hydroxyphenyl)ethane-1,2-diol.

The conversion of 4-hydroxybenzaldehyde to 1,2-bis(4-hydroxyphenyl)ethane-1,2-diol as determined by gas chromatographic analysis of the reaction solution prior to acidification was 97 percent and the percentage yield of 1,2-bis(4-hydroxyphenyl)ethane-1,2-diol isolated was 77.7 percent based on the conversion of 4-hydroxybenzaldehyde.

The 1,2-bis(hydroxyphenyl)ethane-1,2-diols are useful as precursors of the corresponding 1,2-bis(hydroxyphenyl)ethanes to which they can be readily converted. The 1,2-bis(hydroxyphenyl)ethanes are useful as antioxidants and as bifunctional intermediates in the preparation of epoxy resins, polycarbonates, polyesters, and the like.

While the invention has been described with respect to various specific examples and embodiments thereof, it will be understood that the invention is not limited thereto and that many alternatives, modifications, and variations will be apparent to those skilled in the art in light of the foregoing description. Accordingly, it is intended to embrace all such alternatives, modifications, and variations as fall within the spirit and broad scope of the invention.

What is claimed is:

1. A process for electrolytic reductive coupling of hydroxybenzaldehydes which comprises electrolytic reduction at the cathode in an undivided cell fitted with a steel anode by electrolysis in an aqueous alkaline electrolysis medium comprising such hydroxybenzaldehyde, base, and aqueous solvent, and thereafter recovering a 1,2-bis(hydroxyaryl)ethane-1,2-diol product.

2. The process of claim 1 wherein the hydroxybenzaldehyde is represented by the formula

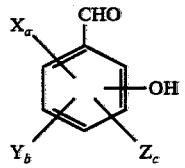

wherein X represents alkyl of 1 to 6 carbon atoms; Y represents alkoxy containing an alkyl of 1 to 6 carbon atoms; Z represents any non-interfering substituent, excluding alkyl and alkoxy; and *a*, *b*, and *c* each independently represent an integer from 0 (zero) to 4, inclusive, with the proviso that the sum of *a*, *b*, and *c* does not exceed 4.

3. The process of claim 1 wherein the electrolysis medium is flowed past two parallel electrodes, the cathode and anode, and thereby contacting both cathode and anode.

4. The process of claim 1 wherein the hydroxybenzaldehyde is 2-hydroxybenzaldehyde and the 1,2-bis(-hydroxyphenyl)-ethane-1,2-diol product is 1,2-bis(2-hydroxyphenyl)ethane-1,2-diol.

5. The process of claim 1 wherein the hydroxybenzaldehyde is 3-hydroxybenzaldehyde and the 1,2-bis(-hydroxyphenyl)-ethane-1,2-diol product is 1,2-bis(3-hydroxyphenyl)ethane-1,2-diol.

6. The process of claim 1 wherein the hydroxybenzaldehyde is 4-hydroxybenzaldehyde and the 1,2-bis(-hydroxyphenyl)ethane-1,2-diol product is 1,2-bis(4-hydroxyphenyl)ethane-1,2-diol.

7. The process of claim 1 wherein the aqueous solvent is water.

8. The process of claim 1 wherein the aqueous solvent contains added alcohol.

9. The process of claim 8 wherein the concentration of the added alcohol is no more than 50 percent by weight.

10. The process of claim 8 wherein the added alcohol is methanol.

11. The process of claim 8 wherein the added alcohol is ethanol.

12. The process of claim 1 wherein the base is sodium hydroxide.

13. The process of claim 1 wherein the concentration of the hydroxybenzaldehyde is from about 5.0 percent to about 30 percent by weight, the base concentration is from about 5.0 percent to about 20 percent, with te proviso that the base to hydroxybenzaldehyde molar ratio is at least 1:1.

* * * * *